US005358550A

United States Patent [19]

Rossborough

[11] Patent Number: 5,358,550

[45] Date of Patent: Oct. 25, 1994

[54] DESULFURIZATION AGENT

[75] Inventor: W. Neil Rossborough, Bay Village, Ohio

[73] Assignee: Rossborough Manufacturing Company, Avon Lake, Ohio

[21] Appl. No.: 966,805

[22] Filed: Oct. 26, 1992

[51] Int. Cl.[5] ..... C21C 7/02

[52] U.S. Cl. ..... 75/533; 75/315

[58] Field of Search ..... 75/315, 533

[56] References Cited

U.S. PATENT DOCUMENTS

| | | | |
|---|---|---|---|
| 3,598,573 | 8/1971 | Freissmuth et al. | 75/55 |
| 3,876,421 | 4/1975 | Takemura | 75/58 |
| 3,896,257 | 7/1975 | Kinoshita | 13/33 |
| 3,929,464 | 12/1975 | Todd et al. | 75/58 |
| 3,985,545 | 10/1976 | Kinoshita | 75/12 |
| 3,998,625 | 12/1976 | Koros | 75/53 |
| 4,040,818 | 8/1977 | Clegg et al. | 75/58 |
| 4,076,522 | 2/1978 | Yoshida | 75/58 |
| 4,078,915 | 3/1978 | Meichsner et al. | 75/58 |
| 4,137,072 | 1/1979 | Kawakami et al. | 75/58 |
| 4,139,369 | 2/1979 | Kandler et al. | 75/58 |
| 4,154,605 | 5/1979 | Freissmuth et al. | 75/58 |
| 4,169,724 | 10/1979 | Freissmuth et al. | 75/58 |
| 4,194,902 | 3/1980 | Gmohling | 75/55 |
| 4,209,325 | 6/1980 | Cooper et al. | 75/58 |
| 4,279,643 | 7/1981 | Jackman | 75/58 |
| 4,315,773 | 2/1982 | Freissmuth et al. | 75/58 |
| 4,345,940 | 8/1982 | Koros | 75/58 |
| 4,364,771 | 12/1982 | Cordier et al. | 75/58 |
| 4,395,282 | 7/1983 | Braun et al. | 75/58 |
| 4,592,777 | 6/1986 | Rellermeyer et al. | 75/58 |
| 4,600,434 | 7/1986 | Kleimeyer et al. | 75/58 |
| 4,705,561 | 11/1987 | Green | 75/58 |
| 4,708,737 | 11/1987 | Skach, Jr. et al. | 75/58 |
| 4,738,715 | 4/1988 | Muller | 75/58 |
| 4,764,211 | 8/1988 | Meichsner et al. | 75/58 |
| 4,765,830 | 8/1988 | Skach, Jr. et al. | 75/53 |
| 4,832,739 | 5/1989 | Meichsner et al. | 75/58 |
| 5,021,086 | 6/1991 | Luydkx et al. | 75/315 |

FOREIGN PATENT DOCUMENTS

| | | |
|---|---|---|
| 8704468 | 7/1987 | European Pat. Off. . |
| 7338237 | 10/1973 | France . |
| 52-75608 | 6/1977 | Japan . |
| 54-61022 | 5/1979 | Japan . |

*Primary Examiner*—Peter D. Rosenberg
*Attorney, Agent, or Firm*—Body, Vickers & Daniel

[57] ABSTRACT

A method for desulphurizing molten pig-iron involving injecting a gas-evolving desulphurizing agent which includes a calcium compound and a gas-forming material comprising of a liquid gas-producing compound absorbed in a porous slag-forming agent and at least 50% wt. magnesium.

39 Claims, No Drawings

DESULFURIZATION AGENT

The present invention relates to the method of desulfurization of molten pig iron and more particularly to a desulfurization agent used to desulfurize the molten pig-iron.

BACKGROUND OF THE INVENTION

The sulfur content in iron ores and other materials commonly used in pig-iron production, i.e. coal and coke, have increased the costs of steel making. As a result, it is becoming increasingly desirable to desulfurize the pig-iron before the iron enters the basic oxygen furnace and/or steel making furnace. Over the years, a wide variety of materials and mixtures have been used to desulfurize the pig-iron. It has long been known that various calcium compounds are good desulfurization agents. It has also been known that magnesium, alone or in combination with various alkaline metal oxides, is also a good desulfurization agent. There have been several patents which disclose the use of calcium oxide and magnesium as the primary desulfurization agents. (See U.S. Pat. Nos. 4,765,830, to Skach; 4,708,737, to Skach; 4,705,561, to Green; 4,139,369, to Candler; 4,137,072, to Kawakami; and 3,998,625 to Koros). Furthermore, desulfurization agents disclosing the use of calcium carbide as the primary desulfurization agent have also been known and well documented. (See U.S. Pat. Nos. 3,598,573, to Freissmuth; 3,929,464, to Todd; and 4,395,282 to Braun).

Recently, the use of a calcium compound and magnesium, in combination with a gas-producing compound, has been used to increase the amount of sulfur removal. It has been found that the gas-producing compound releases a gas upon contact with the molten pig-iron to create a turbulent environment within the molten pig-iron. The released gas primarily breaks down agglomerations of the desulfurization agent and disperses the desulfurization agent throughout the molten pig-iron. The gas-producing agent is typically a hydrocarbon, carbonate or alcohol which has a tendency to release various amounts of gas upon contact with the molten pig-iron. Use of these various gas-producing agents is well documented. (See U.S. Pat. Nos. 3,876,421, to Takmura; 4,078,915, to Meichsner; 4,194,902, to Gmohling; 4,266,969, to Koros; 4,315,773, to Freissmuth; 4,345,940, to Koros; 4,705,561, to Green; 4,592,767, to Reliermeyer; 4,764,211, to Meichsner; 4,832,739, to Meichsner; and 5,021,086, to Luydkx).

Desulfurization agents may also contain various slag-forming agents. Previously, the importance of the slagging agent has been passed over for more immediate concerns about the economics of using various ingredients of the desulfurization agent. Although it is important to use the proper desulfurization components to react with the sulfur in the pig-iron and separate the sulfur from the pig-iron, the composition of the slag is very important to retain the removed sulfur within the slag and not allow the sulfur to re-enter the molten pig-iron.

Various slagging agents have been used for various purposes. In U.S. Pat. No. 4,315,773 a desulfurization agent comprising calcium carbide, a gas-involving compound, and fluorspar is disclosed. Fluorspar is used to modify the properties of the slag to prevent carbon dust production from igniting during the desulfurization.

In U.S. Pat. No. 5,021,086, fluorspars are used to modify the characteristics of the slag increasing the fluidity of the slag during the desulfurization process.

At the present time, concerns of balancing the proper use of various desulfurization agents to remove sulfur from the pig-iron with the slag forming agents, which entraps the removed sulfur and prevents the sulfur from re-entering the pig-iron, have not been previously disclosed in the art. As a result of the inadequate attention to the slag characteristics during the desulfurization process, there is now a demand for better slagging agents to ensure easy removal of the slag and to ensure proper entrapment of the sulfur within the slag to optimize the sulfur removal from the pig-iron.

THE INVENTION

The present invention relates to the method of treating molten ferrous materials such as pig-iron with a desulfurization agent which includes a calcium compound, a gas-producing compound and a slag-forming agent, which removes sulfur from the ferrous materials and entraps the removed sulfur in the slag layer.

In accordance with the principal feature of the present invention, there is provided a method of desulfurization wherein the desulfurization agent has two primary components and is co-injected beneath the surface of the molten pig-iron to remove the sulfur from the pig-iron. The first primary component of the desulfurization agent contains mainly a calcium compound which readily reacts with sulfur in the molten pig-iron. Various calcium compounds can be used as the first primary component of the desulfurization agent such as calcium carbide, calcium carbonate, calcium chloride, calcium cyamide, calcium iodide, calcium nitrate and calcium nitrite. When picking the appropriate calcium compound, it is important to pick a compound such that the calcium ion quickly and easily forms in the molten iron so as to be available to react with the sulfur within the pig-iron. The calcium compound may or may not have a melting point which is less than the temperature of the molten pig-iron. Furthermore, the calcium compound should be selected such that the ions previously associated with the calcium ion do not adversely affect the desulfurization process. Calcium oxide, calcium carbonate, and calcium carbide are generally the types of calcium compounds that may be used individually or in some combination as the first primary desulfurization component. Calcium compounds such as calcium sulfide and calcium sulfate should not be used since the ion associated with the calcium is sulfur, a compound originally intended to be removed from the pig-iron. Calcium oxide, commonly called lime or quicklime, is typically used as the sole component of the first primary component. Although the calcium oxide does not completely melt in the molten pig-iron, the energy within the molten pig-iron causes much of the calcium oxide to disassociate into calcium and oxygen ions. The calcium ions form stable compounds with the sulfur within the pig-iron. The oxygen ions may combine with the calcium sulfur compounds, form oxides with the iron, magnesium or other compounds within the pig-iron, or escape from the pig-iron as oxygen gas. The oxygen compounds which formed within the pig-iron float to the surface of the pig-iron and combine with the slag to be later removed with the sulfur. The particle size of calcium compounds must be small enough to provide the necessary reactivity or activity of the calcium compound with the sulfur in the pig-iron. If the particle size is too large, not enough calcium ions will be produced, resulting in poor desulfurization. Particle sizes which are too small may result in injection problems of the calcium compound into the pig-iron. Generally, the particle size of the calcium compound is maintained between 14–500 U.S. Standard Mesh, and is typically between 200–400 U.S. Standard Mesh.

In accordance with another aspect of the present invention, the second primary component of the desulfurization agent contains a liquid gas-producing compound which is absorbed into a slag-forming agent. Various liquid gas-producing compounds may be used such as hydrocarbons, alcohols, and carbonates. A gas-producing compound is chosen such that gas is produced upon contact with the molten iron. The produced gas thoroughly mixes the various components of the desulfurization throughout the pig-iron to maximize the reaction between the various desulfurization compounds and the sulfur in the pig-iron. The produced gas also breaks up and disperses the desulfurization agents so as to maximize the active sites available for reaction with the sulfur, thereby further increasing the efficiency of sulfur removal from the pig-iron. Although there are various liquid gas-producing components that may be used, the particular types of gas-producing agents are generally limited to compounds that produce gases that are not detrimental to the desulfurization process or the environment about the desulfurization process. Typically, the liquid gas-producing component is a liquid hydrocarbon. The liquid hydrocarbon may be saturated or unsaturated, halogenated or unhalogenated. The liquid hydrocarbon should contain a sufficient amount of volatile components to adequately disperse and break up agglomerations of desulfurization components within the molten pig-iron. Various dispersion techniques for the desulfurization have been used, such as stirring the pig-iron and/or injecting gases into the pig-iron. It has been found that using a gas-producing compound as a component of the desulfurization agent significantly enhances the removal of sulfur from the pig-iron beyond what is obtainable from just stirring and/or injecting gases within the pig-iron. As a result, the dispersion of the desulfurization agents can be accomplished by only injecting the gas-producing compound into the pig-iron or by using the gas-producing compound in conjunction with stirring the pig-iron and/or injecting gases into the pig-iron. The gas-producing compound should also produce sufficient gas to break up and prevent the desulfurization agents from agglomerating within the pig-iron. When the desulfurization compounds are first injected into the pig-iron, the components have a tendency to agglomerate thus reducing the surface area and reaction sites of the desulfurization compounds resulting in reduced sulfur removal efficiency. The turbulent environment caused by the release of the volatile components prevents the desulfurization compounds from forming agglomerations and also breaks up agglomerations which have formed. The gas-producing compound also breaks up the absorbable slag-forming agent so as to evenly disperse the slag-forming agent so that a desired slag is formed on the pig-iron. It is important that there be enough volatile components within the liquid gas-producing compound to generate enough volatile components to break up and disperse the absorbable slag-forming agent, to break up and inhibit agglomerations of the desulfurization compounds and to disperse the desulfurization compounds throughout the molten pig-iron. Typically, the liquid hydrocarbon should contain at least 50% volatile components. Liquid hydrocarbons that have been found to provide adequate volatile components and are readily absorbable in various slag-forming agents are mineral oils. Mineral oils are predominantly paraffin type mineral oils, which are saturated hydrocarbons containing close to 100 percent volatile components. The viscosity of the various commercial mineral oils ranges between 15 to 500 cSt ≈40° C. Common commercial mineral oils are ISO 22, ISO 32, ISO 68, ISO 100, ISO 130 and ISO 460. The viscosity of the liquid hydrocarbon must not be too high such that it cannot be absorbed into the slag-forming agent. Generally, the viscosity of the liquid hydrocarbon is less than 500 cSt ≈40° C. and is typically between 30–130 cSt ≈40° C. The amount of liquid gas-producing component makes up between 1 to 20 weight percent of the second primary component. The amount of liquid gas-producing compound used generally increases as the volatile content of the liquid gas-producing compound decreases. Liquid gas-producing agents containing greater than 70% volatile components typically constitute between 4 to 12 weight percent of the second primary component. The weight percent volatiles of the total desulfurization agent typically range between 2–7%.

In accordance with another feature of the present invention, the second primary component of the desulfurization agent contains magnesium. The magnesium may be in the form of pure magnesium or a magnesium alloy. Magnesium is a highly reactive metal which readily reacts with oxygen and sulfur. The reaction between magnesium and sulfur can be very violent and can cause spattering of the iron during desulfurization. Magnesium has a high affinity for oxygen and will first react with oxygen before reacting with sulfur. As a result, the amount of oxygen in the pig-iron is monitored and controlled to prevent the magnesium from exclusively forming magnesium oxide. Magnesium is a relatively expensive material and is usually the most expensive component of the desulfurization agent. Due to the high cost of magnesium, the amount of magnesium is selected so as to maximize desulfurization without causing the desulfurization agent to become too cost prohibitive to use. During the desulfurization process, the pig-iron may be shielded from the atmosphere by creating an inert environment. The inert environment may be formed by placing the pig-iron in a chamber filled with inert gas or by flowing an inert gas over the top of the pig-iron during desulfurization. The inert environment prevents oxygen from entering the pig-iron and tying up the magnesium during desulfurization. Standard inert gases such as helium, nitrogen, argon, and natural gas can be used to provide shielding during the desulfurization process. The magnesium generally constitutes between 50 to 90 weight percent of the second primary component and typically between 75–87 weight percent. Magnesium amounts that are less than 50 weight percent of the second primary component do not provide adequate desulfurization efficiencies. The magnesium content does not exceed 90 weight percent of the second primary component to prevent waste of magnesium resulting from magnesium not reacting and/or reacting with non-sulfur compounds during desulfurization to reduce the violent magnesium reactions that can cause spattering during desulfurization. The particle size of the magnesium is selected so as to provide sufficient activation sites to efficiently react with the sulfur. The particle size is generally between 14 to 325 U.S. Standard Mesh and typically between 18 to 50 U.S. Standard Mesh.

In accordance with still yet another feature of the present invention, the absorbable slag-forming agent is generally an inorganic material which can absorb a liquid gas-producing compound. It has been found that silicon compounds such as silica are very good slag-forming agents for their properties of enhancing the sulfur removal from the pig-iron. Silica forms a slag on the molten pig of the desired viscosity to effect easy removal of the slag from the pig-iron. The silica also forms a slag which readily entraps the sulfur compounds which float to the pig-iron surface after reacting with various desulfurization agents during the desulfurization process. Calcium and magnesium sulfides and sulfates that form within the pig-iron transfer into the slag during desulfurization. Once the sulfur compounds are in the slag, the sulfur may disassociate into ions and re-enter the pig-iron or the sulfur compounds themselves may re-enter the pig-iron. The silica within the slag tends to inhibit both the disassociation of the sulfur and/or retransfer of the sulfur compounds into the pig-iron by providing a stable and fluid environment for the sulfur compounds. Various silicon compounds can be used as a slag-forming agent. One such compound is amorphous diatomaceous silica containing about 80% or more silicon oxide. Diatomaceous silica is an unconsolidated, porous, low density sediment made essentially of opaline silica remains of diatoms. The diatomaceous silica constitutes primarily silicon oxide and contains other oxides such as aluminum oxide, iron oxide, calcium oxide and magnesium oxide. The low density and porous properties of the diatomaceous silica make it an excellent medium to absorb the liquid gas-producing compound. Diatomaceous silica can typically absorb up to about 40% by weight the liquid gas-producing compound. The particle size of the slag-forming agent should be small enough for easy transport into the pig-iron, yet not too small to adversely affect the absorbable properties of the slag-forming agent. Generally, the particle size of the slag-forming agent is between 12 to 100 U.S. Standard Mesh and typically between 16 to 65 U.S. Standard Mesh. The amount of slag-forming agent generally constitutes between 5 to 20 weight percent of the second primary component of the desulfurization agent and typically between 10–15 weight percent.

In accordance with another feature of the present invention, the second primary component of the desulfurization agent may include additional slag-improvement agents to generate a more fluid slag and to reduce the amount of liquid iron entrapped within the slag. Various slag-improvement agents can be used such as metallurgical fluorspar, dolomite lime, sodium carbonate, sodium chloride, potassium chloride, cryolite, colemanite, calcium chloride, sodium fluoride and soda ash. Typically, a metallurgical fluorspar is used since a metallurgical fluorspar such as calcium fluoride exhibits the best modifications to the physical properties of the slag in conjunction with the silica slag-forming agent. Generally, not more than 10% of the second primary component contains a metallurgical fluorspar since too much of a metallurgical fluorspar has a tendency to reduce the viscosity of the slag to a point whereby the sulfur easily transfers back into the molten pig-iron. Calcium fluoride has been found to be one of the better metallurgical fluorspars for use as a slag-improvement agent. Generally, the amount of metallurgical fluorspar ranges between 0–10% of the second primary component of the desulfurization agent. The particle size of the slag-improvement agent generally is between 14–325 U.S. Standard Mesh.

In accordance with yet another feature of the present invention, lime may be added to the second primary component of the desulfurization agent to further enhance the sulfur removal from the pig-iron and to reduce the violent reaction of the magnesium in the molten pig-iron. Lime (calcium oxide) readily disassociates into calcium and oxygen ions within the molten pig-iron. The free calcium ions react with the sulfur in the pig-iron to form calcium sulfide and sulfate. The lime also reduces the violent reactions which occur between the magnesium and the sulfur in the pig-iron. Although the exact mechanism involved between the lime and magnesium which dampens the reaction of the sulfur with the magnesium is unknown, applicant is of the belief that the oxygen ions from the calcium oxide first react with the magnesium to produce magnesium oxide then disassociate from the magnesium to allow the magnesium to react with the sulfur. Therefore, it is believed that the intermediate step of the magnesium reacting with the oxygen reduces the violent nature of the reaction between the magnesium and the sulfur within the pig-iron. The amount of lime in the second major component is limited to not more than 20% of the second primary component. The particle size of the lime generally is between 14–500 U.S. Standard Mesh. Typically, the particle size is not greater than the particle size of the magnesium powder.

In accordance with still yet another aspect of the present invention, the amount of the first primary component which is added to the pig-iron may be varied with respect to the second primary component to obtain the optimum amount of desulfurization. Generally, the first primary component is added in larger quantities than the second primary component. The weight ratio of the first primary component to the second primary component ranges between 2:1 to 5:1. The ratio is primarily dependent on the amount of sulfur in the pig-iron. Typically, the ratio is 3:1 to 4:1 for a lime-based desulfurization system.

The primary object of the present invention is to provide a method of desulfurization of ferrous materials by maximizing the sulfur transfer to the slag.

Another object of the present invention is the provision of a method of desulfurization of ferrous materials as defined above whereby a slag is formed which retains sulfur compounds formed during desulfurization and inhibits the retransfer from the slag into the ferrous materials.

Yet another object of the present invention is to provide a method of desulfurization of ferrous materials by adding a desulfurization agent which includes two primary components, whereby the first primary component contains a calcium compound and the second primary component contains magnesium, a gas-producing compound and an absorbable slag-forming agent.

Still yet another object of the present invention is a provision of a method of desulfurization of ferrous materials as defined above, whereby the second primary component of the desulfurization agent further includes the addition of a slag-improvement agent to generate a more fluid slag and to reduce the amount of liquid ferrous materials entrapped within the slag.

Another object of the present invention is the addition of lime to the second primary component to increase the sulfur removal from the ferrous material and to reduce the violent reactions of the magnesium with the sulfur.

These and other objects and advantages will become apparent to those skilled in the art from the following description of the invention.

PREFERRED EMBODIMENT

The desulfurization agent of this invention exhibits improved desulfurization of molten ferrous materials such as pig-iron by the use of a improved slag system, which entraps the sulfur compounds formed during the desulfurization process and does not allow the sulfur compounds to re-enter the ferrous materials. The desulfurization agent includes two primary components which are typically co-injected into the molten ferrous materials.

The first primary component consists primarily of calcium compounds, which readily disassociate into calcium ions within the molten pig-iron and react with the sulfur to produce various calcium and sulfur compounds. The first primary component of the desulfurization agent can contain a single calcium compound or a mixture of various calcium compounds. The particular calcium compound used must at least partially disassociate into calcium ions within the molten pig-iron. The temperature of the molten pig-iron is about 2400° F. It has been found that some calcium compounds perform better than others during the desulfurization of pig-iron. Calcium oxide or lime has been found to be one of the best calcium compounds for use in the present invention. The calcium oxide is crushed to a size ranging between 14–200 U.S. Standard Mesh to provide adequate reaction and activation sites on the calcium oxide and to improve the ionization of the calcium within the molten pig-iron. Preferably, the grain size of calcium oxide is between 200–400 U.S. Standard Mesh.

The second primary component of the desulfurization agent includes magnesium, a gas-producing compound and an absorbable slag forming agent. The magnesium is a powerful reducing agent which readily reacts with sulfur and oxygen within the pig-iron. The magnesium content constitutes at least 50% and not more than 90 weight percent of the second primary component. The addition of magnesium in amounts greater than 90 weight percent of the second primary component may cause too violent a reaction between the magnesium and sulfur resulting in excessive spattering and possibly lower sulfur removal efficiencies. The magnesium preferably is in the form of commercial grade magnesium; however, magnesium alloys or purer forms of magnesium can be used. The magnesium is crushed to granular or powdered form such that it has a size ranging between 14–325 U.S. Standard Mesh. Preferably, the magnesium is between 18–50 U.S. Standard Mesh.

The gas-producing compound of the second primary component is preferably a liquid hydrocarbon. The liquid hydrocarbon preferably contains greater than 70% volatile components. A liquid mineral oil having a volatile content of about 100 percent has been found to be a good gas-producing compound. The gas produced from the liquid mineral oil should be sufficient to increase the amount of dispersion of the desulfurization agents in the pig-iron and to inhibit the formation of agglomerations within the pig-iron. The volatile components of the liquid mineral oil also break up and disperse the absorbable slag-forming agent so that a desired slag is formed during desulfurization. Preferably, the weight percentage of volatiles of the desulfurization agent is about 6%. The liquid mineral oil may have various viscosities, but the viscosity must not be too great such that the liquid mineral oil cannot be properly absorbed into the absorbable slag-forming agent. Typically, the viscosity of the liquid mineral oil is less than 500 cSt at 40° C. and is preferably between 30–130 cSt at 40° C. Liquid mineral oils having ISO values between 30–130 have been found to have the proper viscosity such that they readily absorb into the absorbable slag-forming agent. Liquid mineral oils having viscosities of less than 15 cSt at 40° C. are not properly retained in the absorbable slag-forming agent, thus causing problems with injection of the second primary component into the pig-iron. The amount of liquid mineral oil within the second primary component generally ranges between 1–20% of the weight percent of the second primary component. Preferably, a liquid mineral oil containing at least 70% volatile components constitutes between 8–12% weight percent of the second primary component.

The absorbable slag-forming agent both absorbs a liquid gas-producing component and produces a slag on top of the molten pig-iron which retains the removed sulfur. Silica produces a highly desirable slag which has a relatively fluid consistency that enhances the sulfur removal by entrapping the sulfur compounds in the slag. Preferably, amorphous diatomaceous silica is selected as the absorbable slag-forming agent. Amorphous diatomaceous silica has a relative high absorbability of various liquid gas-producing components. Generally, the diatomaceous silica can absorb up to about 40 weight percent of a liquid gas-producing agent. The diatomaceous silica consists of primarily silicon oxide and contains other oxides such as aluminum oxide, iron oxide, calcium oxide and magnesium oxide. Diatomaceous silica generally constitutes between 5–20% of the weight percent of the second primary component and typically is between 10–15% weight percent. The particle size of the diatomaceous silica ranges between 12 to 100 U.S. Standard Mesh. The particle size should not be too small such as to adversely affect the absorbable characteristics of the diatomaceous silica. Preferably, the particle size is between 16 to 65 U.S. Standard Mesh.

Lime may also be added to the second primary component in small quantities. It has been found that small quantities of lime mixed with the magnesium helps reduce the violent reaction of the magnesium with the sulfur. The amount of lime that is added to the second primary component ranges between 0–20% weight percent of the second component and is typically not more than 10 weight percent. The particle size of the lime ranges between 14–500 U.S. Standard Mesh and is preferably equal to or less than the particle size of the powdered magnesium.

Additional slag-improvement agents may be added to the second primary component of the desulfurization agent to generate a more fluid slag to reduce the amount of liquid iron which is entrapped within the slag. Preferably, calcium fluoride is used as the slag-improvement agent since calcium fluoride best compliments the slag-forming properties of the silica slag-forming agent. Preferably between 0–10 weight percent calcium fluoride is added to the second primary component. Amounts of calcium fluoride greater than 10% may result in a slag that is excessively fluid and does not properly retain the sulfur compounds in the slag. The particle size of the calcium fluoride is between 14–325 U.S. Standard Mesh.

The two primary components of the desulfurization agent are generally injected into the molten pig-iron; however, the two primary components may also be stirred into the pig-iron. Preferably, the two primary components are simultaneously co-injected into the pig-iron. Before injection of the two primary components, the two primary components are fluidized. Preferably, the two primary components are fluidized in a semi-dense state before being co-injected into the pig-iron. The particle size of the two primary components must not be too small such that either of the two primary components becomes too tightly packed and cannot be properly fluidized. Particle sizes that are less than 200 U.S. Standard Mesh tend to pack together too closely for proper fluidization. The fluidized desulfurization agent is carried into the pig-iron by a carrier gas. The carrier gas should be inert. The carrier gases commonly used are argon, nitrogen, helium, natural gas or various other inert gases. Preferably, the carrier gas is nitrogen. Generally, the pressure of the carrier gas necessary to inject the desulfurization into the molten pig-iron is between 75–80 PSI; however, the pressure may be more or less depending on the particle sizes of the various desulfurization components and the depth at which the desulfurization components are injected into the pig-iron. The co-injection of the two primary components with a carrier gas results in better dispersion of the desulfurization agents throughout the pig-iron. Additional inert gases may be injected into the pig-iron and/or the pig-iron may be stirred to further disperse the co-injected desulfurization agent in the pig-iron.

An inert shielding gas may be used to protect the pig-iron from the atmosphere during desulfurization. Standard shielding gases such as argon, nitrogen, helium and/or natural gas may be used. The shielded environment primarily prevents oxygen from interacting with the molten pig-iron. The slag formed on top of the pig-iron also serves as a shield against the atmosphere. Particularly, the silica within the slag forms within the slag a semi-barrier against oxygen. When too much oxygen is available in the pig-iron, the desulfurization effect of magnesium within the pig-iron is neutralized since the magnesium tends to react with oxygen before reacting with sulfur. The magnesium oxide which forms enters the slag thus removing the magnesium from the pig-iron. If too much magnesium oxide is formed, the physical properties of the slag are adversely affected since magnesium oxide reduces the viscosity of the slag. A slag with a too low viscosity will allow the sulfur compounds in the slag to retransfer into the pig-iron. The use of a shielding gas can be used to control the oxygen content of the pig-iron to maximize the efficiency of the desulfurization agent.

The weight percentage of the first primary component of the desulfurization agent is preferably greater than the weight percentage of the second primary component of the desulfurization agent. Typically, the weight ratio between the first and second primary components is between 2:1 to 5:1. The first primary component of the desulfurization agent may range between 66–83 weight percent of the desulfurization agent. Preferably, the first primary component constitutes between 75–80 weight percent of the desulfurization agent.

Tests were run on the desulfurization agent as illustrated in Table I. The first primary component (P1) and the second primary component (P2) were co-injected into the pig-iron by nitrogen gas. The first primary component contained calcium oxide and the second primary component contained 84% magnesium, 3.7% calcium oxide, 6% mineral oil and 6.3% diatomaceous silica. The weight percent volatiles in the desulfurization agent were about 6%. The co-injection times ranged between 5–15 minutes. The molten pig-iron was maintained at 2400° F. (1333° C.) during the desulfurization process.

TABLE I

| Trial | # of Runs | Initial Sulfur % | Final Sulfur % | Sulfur Aim | P1 Lbs/ Min. | P2 Lbs/ Min. | Tons of Pig Iron (Metric Tons) | Slag (Lbs) |
|---|---|---|---|---|---|---|---|---|
| A | 35 | 0.042 | 0.012 | 0.010 | 100 | 30 | 180 | 2436 |
| B | 13 | 0.056 | 0.013 | 0.015 | 100 | 30 | 180 | 2500 |
| C | 12 | 0.049 | 0.014 | 0.018 | 100 | 30 | 180 | 2718 |
| D | 61 | 0.050 | 0.014 | 0.020 | 100 | 30 | 180 | 2343 |

Although the invention has been described with reference to specific embodiments, variations within the scope of the following claims will be apparent to those skilled in the art.

It is claimed:

1. A method for desulfurizing molten pig-iron which comprises injecting into said molten pig-iron a gas-evolving desulfurization agent, whereby the evolved gas mixes said agent in said pig-iron, said agent being injected beneath the surface of said pig-iron and includes a calcium compound and a gas-forming material comprising a liquid gas-producing compound absorbed in a porous slag-forming agent and at least 50 weight percent magnesium.

2. A method according to claim 1, wherein said calcium compound is selected from the class consisting of calcium oxide, calcium carbide and calcium cyanamide.

3. A method according to claim 2, wherein said calcium compound is calcium oxide.

4. A method according to claim 1, wherein the particle size of said desulfurization agent is between 14 to 500 U.S. Standard Mesh.

5. A method according to claim 1, wherein said gas-forming material contains up to 90 weight percent magnesium.

6. A method according to claim 1, wherein said slag forming agent of said gas-forming material is diatomaceous silica.

7. A method according to claim 1, wherein said gas-forming material includes a slag-improvement agent selected from the class consisting of fluorspar, sodium carbonate, sodium chloride and potassium chloride.

8. A method according to claim 1, wherein said gas-forming material comprises:

| | |
|---|---|
| a. Magnesium | 50–90 Wt. % |
| b. Lime | 0–20 Wt. % |

-continued

| | |
|---|---|
| c. Diatomaceous Silica | 5–20 Wt. % |
| d. Liquid Gas-Producing Compound | 1–20 Wt. % |
| e. Fluorspar | 0–10 Wt. % |

9. A method according to claim 1, wherein said weight ratio of said calcium compound to said gas-forming material injected into said pig-iron ranges between 2:1 and 5:1.

10. A method according to claim 1, wherein said desulfurization agent is injected into said pig-iron via a non-sulfur containing carrier gas.

11. A method according to claim 1, wherein said liquid gas-producing compound is a liquid hydrocarbon.

12. A method according to claim 11, wherein said liquid hydrocarbon has a viscosity less than 500 cSt at 40° C.

13. A method according to claim 12, wherein said liquid hydrocarbon is a mineral oil.

14. A method according to claim 1, wherein said calcium compound and said gas-forming material are combinable for co-injection into said pig-iron.

15. A method according to claim 10, wherein said carrier gas is nitrogen.

16. A method according to claim 1, wherein said absorbable slag-forming agent absorbs up to 40 percent by weight said liquid gas-producing agent.

17. A desulfurization agent for removing sulfur from molten pig-iron, said agent being injected beneath the surface of said molten pig-iron, said agent includes a calcium compound selected from a class consisting of calcium oxide, calcium carbide and calcium cyanamide, and a gas-forming material comprising 50–90 weight percent magnesium, 5–20 weight percent absorbable porous slag-forming agent, 1–20 weight percent liquid gas-producing compound, 0–20 weight percent lime and 0–10 weight percent slag-improvement agent.

18. A desulfurization agent as defined in claim 17, wherein said calcium compound is calcium oxide.

19. A desulfurization agent as defined in claim 17, wherein said absorbable slag-forming agent is diatomaceous silica.

20. A desulfurization agent as defined in claim 17, wherein said slag-improvement agent is fluorspar.

21. A desulfurization agent as defined in claim 17, wherein said liquid gas-evolving compound is a liquid hydrocarbon.

22. A desulfurization agent as defined in claim 17, wherein said agent is injected into said pig-iron via a non-sulfur containing carrier gas.

23. A desulfurization agent as defined in claim 17, wherein the weight ration of said calcium compound to said gas-forming compound ranges between 2:1 to 5:1.

24. A desulfurization agent as defined in claim 17, wherein the particle size of said desulfurization agent ranges between 14 to 500 U.S. Standard Mesh.

25. A desulfurization agent as defined in claim 17, wherein said calcium compound and said gas-forming compound are combinable for co-injection into said pig-iron.

26. A desulfurization agent as defined in claim 17, wherein the volatile content of said gas-producing compound is between 2–7 weight percent of said desulfurization agent.

27. A desulfurization agent as defined in claim 22, wherein said carrier gas is nitrogen.

28. A desulfurization agent as defined in claim 17, wherein said liquid gas-producing agent has a viscosity less than 500 cSt at 40° C.

29. A desulfurization agent as defined in claim 21, wherein said liquid gas-producing agent has a viscosity less than 500 cSt at 40° C.

30. A desulfurization agent as defined in claim 29, wherein said liquid hydrocarbon is a mineral oil.

31. A desulfurization agent as defined in claim 17, wherein said absorbable slag-forming agent absorbs up to 40 percent by weight said liquid gas-producing agent.

32. A desulfurization agent as defined in claim 19, wherein said absorbable slag-forming agent can absorb up to 40 percent by weight said liquid gas-producing agent.

33. A desulfurization agent for removing sulfur from ferrous materials, said agent including a calcium compound and a gas-forming agent comprising an absorbable slag-forming agent and a liquid gas-producing compound, said liquid gas-producing compound having a viscosity such that said absorbable porous slag-forming agent absorbs said liquid gas-producing compound.

34. A desulfurization agent as defined in claim 33, wherein said absorbable slag-forming agent is diatomaceous silica.

35. A desulfurization agent as defined in claim 33, wherein said liquid gas-producing compound viscosity is not greater than 500 cSt at 40° C.

36. A desulfurization agent which is combined with ferrous materials for removal of sulfur from said materials, said agent consists of 33–83% by weight of a calcium compound selected from the class consisting of calcium oxide, calcium carbide, and calcium cyanamid, and 17–33% of a gas-forming material consisting of 50–90% magnesium, up to 20% lime, 5–20% absorbable porous slag-forming agent, 1–20% liquid gas-forming compound, and up to 10% slag-improvement agent, and said particle size of said agent ranges from 14–500 U.S. Standard Mesh.

37. A desulfurization agent as defined in claim 36, wherein said absorbable porous slag-forming agent is diatomaceous silica.

38. A desulfurization agent as defined in claim 36, wherein said slag-improvement agent is selected from a class consisting of fluorspar, sodium carbonate, sodium chloride and potassium chloride.

39. A desulfurization agent as defined in claim 37, wherein said slag-improvement agent is selected from a class consisting of fluorspar, sodium carbonate, sodium chloride and potassium chloride.

* * * * *